US006871911B2

(12) United States Patent
Alexander, Jr.

(10) Patent No.: US 6,871,911 B2
(45) Date of Patent: Mar. 29, 2005

(54) CONTINUOUSLY ADJUSTABLE LAWN FURNITURE HAVING TUBULAR CONSTRUCTION

(76) Inventor: John G. Alexander, Jr., 4303 Ingham Ave., Columbus, OH (US) 43214

( * ) Notice: Subject to any disclaimer, the term of this patent is extended or adjusted under 35 U.S.C. 154(b) by 0 days.

(21) Appl. No.: 10/461,630

(22) Filed: Jun. 12, 2003

(65) Prior Publication Data

US 2004/0251726 A1 Dec. 16, 2004

(51) Int. Cl.[7] ..... A47C 4/00; A47C 7/62; A47C 1/01

(52) U.S. Cl. ..... 297/344.18; 297/344.12; 297/452.2; 297/440.24; 297/46; 297/188.21

(58) Field of Search ..... 297/344.18, 344.12, 297/325, 452.2, 440.24, 46, 18, 188.21; 248/599, 600, 622, 188.8; 403/109.5, 109.2, 109.1, 109.8

(56) References Cited

U.S. PATENT DOCUMENTS

| | | | | | |
|---|---|---|---|---|---|
| 56,410 | A | | 7/1866 | Condie | |
| 282,182 | A | | 7/1883 | Flammang | |
| 1,178,264 | A | | 4/1916 | Rhodes | |
| 1,526,920 | A | * | 2/1925 | Liptak | 248/624 |
| 1,918,519 | A | * | 7/1933 | Clements | 403/66 |
| 2,615,499 | A | * | 10/1952 | De Loss | 297/325 |
| 2,871,921 | A | * | 2/1959 | Arnold | 297/39 |
| 4,174,900 | A | * | 11/1979 | Ina | 248/163.1 |
| 4,772,068 | A | | 9/1988 | Gleckler et al. | 297/39 |
| 4,948,197 | A | * | 8/1990 | Sansing | 297/188.14 |
| 5,494,333 | A | * | 2/1996 | Wilson | 297/344.18 |
| 5,498,054 | A | | 3/1996 | Tomlinson | 297/16.2 |
| 5,522,642 | A | * | 6/1996 | Herzog | 297/344.18 |
| 5,597,148 | A | * | 1/1997 | Gospodarich | 248/311.2 |
| 5,848,822 | A | * | 12/1998 | Wu | 297/344.18 |
| 5,899,525 | A | | 5/1999 | Tseng | 297/51 |
| 6,012,769 | A | | 1/2000 | Hsueh et al. | 297/19 |
| 6,036,148 | A | | 3/2000 | Shank | 248/188.5 |
| 6,056,353 | A | * | 5/2000 | Meara | 297/41 |
| 6,095,607 | A | | 8/2000 | Wenzel | 297/344.18 |
| 6,106,056 | A | | 8/2000 | Wegner | 297/16.1 |
| 6,182,939 | B1 | * | 2/2001 | Schoepper | 248/599 |
| 6,345,862 | B1 | | 2/2002 | Meinburg | 297/55 |
| 6,361,107 | B1 | | 3/2002 | Alexander | 297/39 |
| 6,450,569 | B1 | * | 9/2002 | Liu | 297/39 |
| 6,471,288 | B2 | | 10/2002 | Alexander | 297/56 |
| 6,568,757 | B2 | * | 5/2003 | Lin et al. | 297/344.1 |
| 2003/0102700 | A1 | * | 6/2003 | Lin | 297/183.9 |

* cited by examiner

*Primary Examiner*—Peter M. Cuomo
*Assistant Examiner*—Sarah C. Burnham
(74) *Attorney, Agent, or Firm*—Eley Law Firm Co.; James R. Eley; Michael A. Forhan

(57) ABSTRACT

A folding chair having adjustable, telescoping rear legs for use on level ground and sloping terrain. The chair is continuously adjustable by a user while in a seated position, each of the telescoping rear legs housing a biasing means to mechanically assist the user in their adjustment. Easily-deployable clamps are provided to enable a user to adjust the inclination of the seating arrangement with a single hand.

15 Claims, 3 Drawing Sheets

CONTINUOUSLY ADJUSTABLE LAWN FURNITURE HAVING TUBULAR CONSTRUCTION

FIELD OF THE INVENTION

This invention relates to rugged, yet lightweight, outdoor chairs that are continuously adjustable over a range of angles to accommodate varying sloped terrain.

BACKGROUND OF THE INVENTION

Spectators of various outdoor events, such as golf, baseball, soccer, fireworks displays and parades, for example, typically use lawn chairs for seating during the event. Seating is commonly placed on nearby grass areas that may or may not be flat. A broad range of portable, folding and compact outdoor chairs is available in today's market but their designs are optimized for level or horizontal surfaces. The chairs are not the problem. Rather it is the way the various portable chairs are used on sloping terrain.

Depending on the angle of the ground to horizontal, or slope, the seat of most chairs remains roughly parallel (actually around 6°) relative to the ground upon which it is situated, that is, assuming that the seated individual is facing downhill. As the slope of the ground increases, the angle of an individual's seated position relative to horizontal decreases. As the seating angle decreases and then becomes negative, the seated individual's constant attempt to brace himself to keep from sliding out of the chair or to keep the chair from toppling does not create a situation of relaxed comfort, an important goal of sitting in a chair in the first place. At some point of discomfort individuals, with nothing more than a fixed-leg lawn chair, may very well elect to sit on the ground or try to find flatter ground for their chairs rather than fight the slope. Unfortunately, flatter ground simply may not be available or may offer an inferior viewing perspective of the event being observed.

In order to compensate for various slopes, the legs of a chair should be easily and continuously adjustable to adapt to a wide degree of slopes in order to maintain a somewhat normal and comfortable seating angle. In addition, since a portable chair may be subject to rules and restrictions at certain spectator events, a chair's capacity to adapt to sloping terrain seating may be subject to certain physical limitations. For example, the rules covering portable seating at the Memorial Golf Tournament held at the Muirfield Village Golf Club in Dublin, Ohio prohibit, among other things, chairs with arms and chairs over a certain height. Finally, since seated attendees at an event may be already burdened with other carried items, a portable chair should be both lightweight and quickly adjustable.

Numerous attempts to solve this seating problem have resulted in patents being granted for various configurations of adjustable portable chairs. However, as will be evident from the discourse below, each of these attempts have shortcomings, which prevent them from fully achieving a practical solution to the slope problem which may stem from the difficulty in use or the cost to manufacture.

For example, U.S. Pat. No. 4,772,068, issued to Glecker et al., discloses a portable fishing chair intended for use on sloping terrain by fishermen and campers. Glecker et al.'s chair employs an adjustable extension that is limited to three fixed positions, which accommodates only three different degrees of slope. The chair is not easily adjustable from the multiple, fixed seating positions and appears relatively complicated. In addition, the chair has arms, which would prevent it from being used at certain events.

U.S. Pat. No. 5,494,333, issued to Wilson, discloses a chair, which provides either three or four individually adjustable legs such that the chair can be used on a variety of terrain. Like Glecker et al. the number of positions is fixed and thus cannot conform continuously to a wide degree of slopes. The legs do not appear to be easily adjustable by a user in a seated position. Like the Glecker chair, the Wilson chair has arms and thus would not conform to events where armed chairs are not permitted.

U.S. Pat. No. 5,522,642, issued to Herzog, discloses a folding stool, with individually adjustable legs, that is adaptable for use on various sloped terrains. However, like the other chairs in the cited art, the legs are not adjustable from a seated position and adjustment is limited to a fixed number of angles based upon predetermined, fixed hole spacings. While Herzog has no arms, its ability of increasing the height of the stool for better viewing over crowds would violate chair policies for events, which regulate the maximum allowable seat height for portable seating.

U.S. Pat. No. 6,036,148, issued to Shank, discloses a folding outdoor chair having four, independently adjustable legs. However, like the other chairs in the cited art, the legs do not appear to be easily adjustable from a seated position and would require multiple settings of the various legs.

U.S. Pat. No. 6,361,107, issued to the Applicant, John G. Alexander, discloses a folding stool and chair that is adjustable by a seated individual over a continuous range of slopes. While Alexander represents significant advancement over the art, it is somewhat heavy, expensive to fabricate and may require more than one hand to return the chair legs to their fully extended position.

What is needed is sturdy, lightweight, durable and portable lawn furniture that has a comfortable seat and that can be easily adjustable to varying terrain by the user from a seated position.

SUMMARY OF THE INVENTION

One aspect of the present invention provides a portable folding chair for use on varying sloped surfaces ranging from zero degrees to about twenty degrees. The chair comprises a front leg assembly constructed of tubular material, and is constructed of a first and second parallel forward leg members and a horizontal member located at the upper extent of the forward leg members. The horizontal member is substantially perpendicular to the leg members, in spaced relationship therewith and provides a rear seat support member.

The chair also includes a rear leg assembly constructed of tubular material of a first diameter, pivotally attached to the front leg assembly. The rear leg assembly has a first and second parallel fixed rear leg members and a horizontal member located at the upper extent of the rear leg members, in spaced relationship therewith and provides a front seat support member. The rear leg assembly also includes a first and second sliding rear legs, also constructed of a tubular material of a second diameter which enable them to be telescopically engaged with the first and second rear leg members.

On the outside surface of the rear legs are first and second locking means located near the lower extents of the first and second rear leg members for retaining the first and second sliding rear legs in determinable positions until unlocked. A seat is formed by suspending a flexible seating material between the front and rear seat support members. A pivoting seat back assembly is constructed of tubular material and is attached to the front leg assembly. The seat back assembly has first and second vertical parallel seat back members, a first horizontal member located at the lower extent of said seat back members, in spaced relationship therewith, and a second horizontal member located at the upper extent of said seat back.

Another aspect of one embodiment of the invention comprises a rear leg assembly with a first and second biasing means acting against said first and second fixed rear leg members and said first and second sliding rear legs for mechanically assisted extension of the sliding members from the fixed leg members when the locking means are selectively disengaged.

These and other features, aspects and advantages of the present invention will become better understood with the regard to the following description, appended claims and accompanying drawings.

DESCRIPTION OF THE PREFERRED EMBODIMENT(S)

Figure 1:
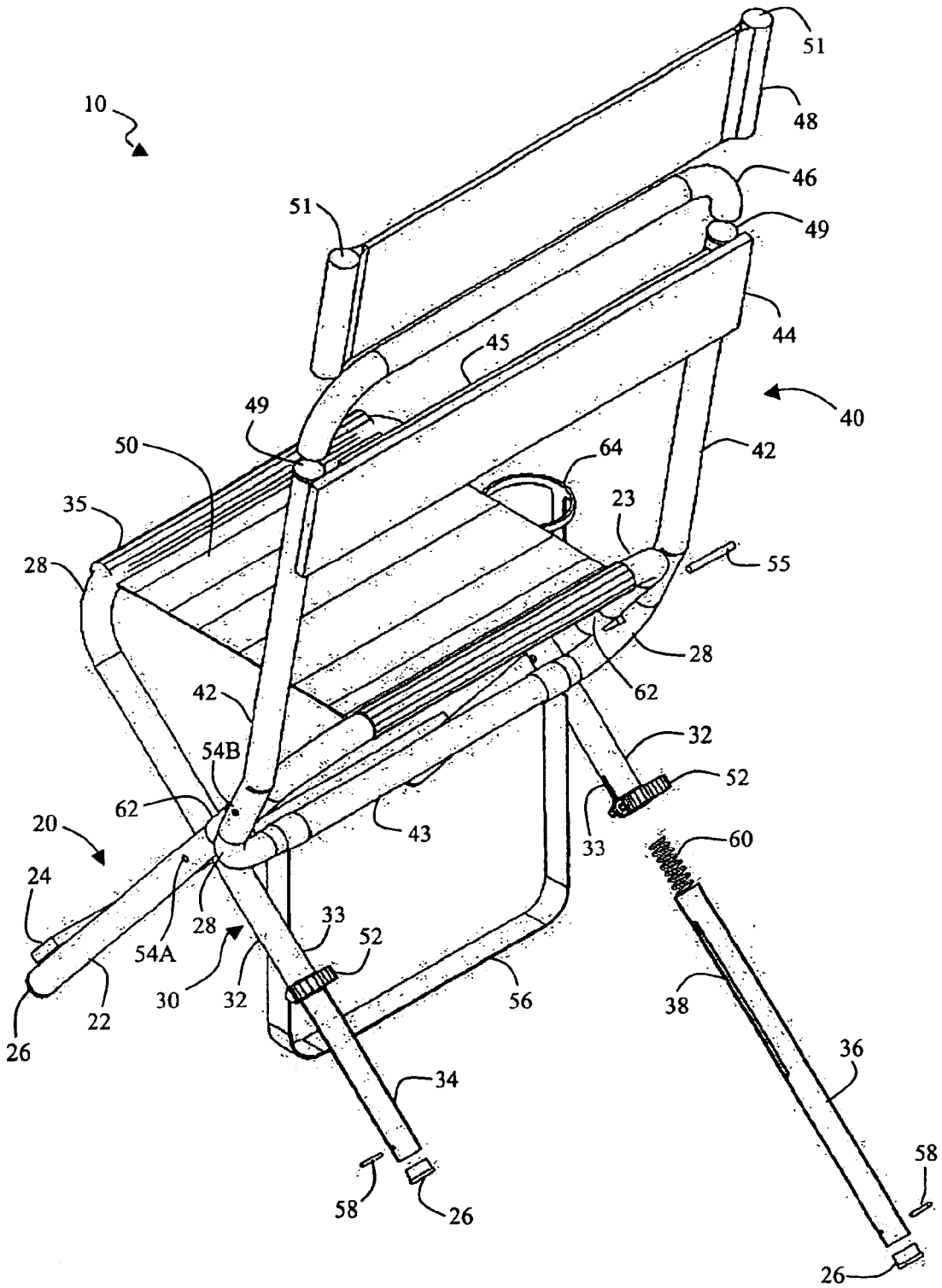
FIG. 1 is a rear perspective view of one embodiment of the claimed invention shown with one of the sliding rear legs in an exploded position.
Figure 2:
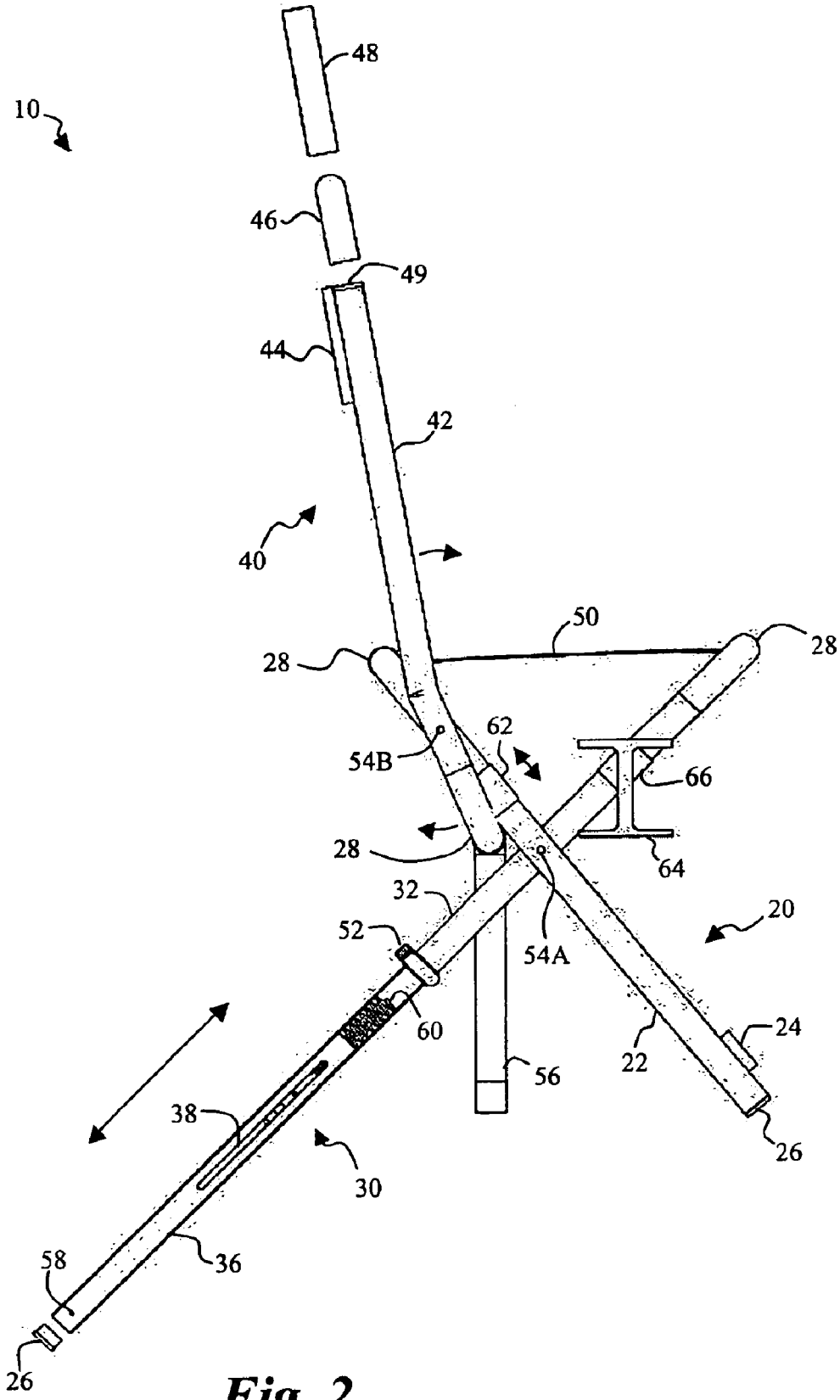
FIG. 2 is a side elevational view of one embodiment of the claimed invention shown with one of the sliding rear legs in an exploded position.

Referring to FIGS. 1 and 2, a folding chair 10 according to a first embodiment of the present invention is shown. Front leg assembly 20 preferably consists of a unitary tubular frame having two front parallel leg members 22 and an upper horizontal frame member 23 extending to about the height of the seat 50. The tubular frame is preferably constructed from a lightweight material such as steel or aluminum and bent in such a configuration to provide both the leg and horizontal members. In the alternative, the frame may be assembled from numerous component parts, made from plastic, metal, composites or other suitable materials, and then joined with their corresponding components with elbows, such as shown at 28. Each of the front leg members 22 of front leg assembly 20 may be terminated in a foot arrangement, such as at 26, which may be formed from metal, plastic, rubber or other suitable material and be of either an internally or externally mounted configuration. A second horizontal member 24 may be provided near the lower extents of the front leg members 22 for additional strength but is not required. The second horizontal member 24 may be configured to display printed information or other promotional material.

The front leg assembly 20 is preferably pivotally coupled to a rear leg assembly 30, as at pivot points 54A. The rear leg assembly 30 preferably has two parallel leg members 32 and an upper horizontal member 35. Pivot points 54A may be provided with pivot pins 55 that extend entirely through the diameter of the leg members 22, 32. Like the front leg assembly 20, rear leg assembly 30 is preferably constructed from a unitary tubular material but may be assembled from component parts and joined with elbows, as at 28. Differing from the front leg assembly 20, whose front leg members 22 are designed to rest upon the ground, the rear leg members 32 of the rear leg assembly 30 of a first diameter are shortened to provide for cooperation between the leg members, which are fixed, and sliding rear legs 34, 36, having a second diameter. This permits the sliding rear legs 34, 36 to be adjusted up or down depending upon the slope of ground upon which the chair 10 may be employed. It is preferable that the outside diameter of sliding rear legs 34, 36 be smaller than the inside diameter of the fixed leg members 32 of rear leg assembly 30 rather than the inverse. In this manner, the sliding rear legs 34, 36 are housed on the inside of their counterpart rear leg members 32 of the rear leg assembly 30. As with the front leg members 22, the lower extents of the sliding rear legs 34, 36, are preferably provided with feet, as at 26, to prevent dirt from plugging the leg members. In order to retain a biasing means, such as a compressible spring 60, within the cavities of the sliding rear legs 34, 36, a stop pin 58 is provided proximal the lower extents of the sliding rear legs.

The extension of sliding rear leg 34, 36 is selectively maintained by an easily releasable locking means, as at 52. Although it is envisioned that numerous releasable locking arrangements may be adapted to function in this application, it has been found that a compression type clamp, such as a quick-release clamp of the type widely used in the bicycle industry for such purposes as a seat collar, has proven to be effective in providing a strong clamping action which is easily disengaged for adjusting the extension of sliding rear legs 34, 36. When employing a compression type locking mechanism at 52, it is preferable to cut slots, as at 33, near the lower extents of each of the fixed rear leg members 32. In this regard, the slotted portions over which the locking means 52 are positioned may be compressed to engage the respective sliding rear legs 34, 36 housed within fixed rear leg members 32 when the locking means are actuated.

Figure 3:
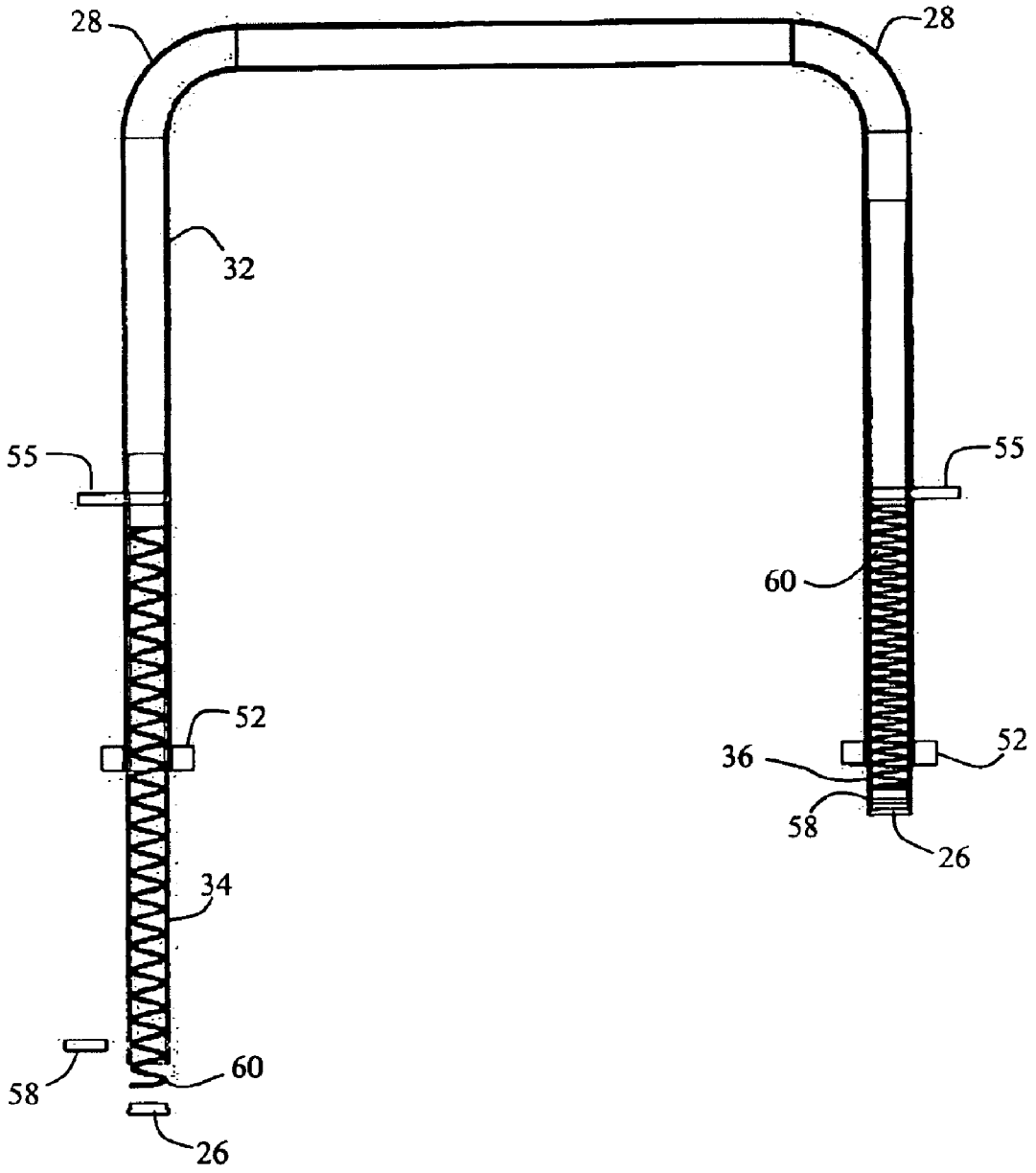
FIG. 3 is a cross sectional view of a portion of the rear leg assembly according to an embodiment of the present invention, showing one biasing spring in its fully extended position and another biasing spring in its fully compressed state.

Sliding rear legs 34, 36 are preferably provided with milled slots, as at 38, located on opposing sides towards the upper extents of each leg member. The lengths of the milled slots 38 determines the maximum lineal extent that each of the respective fixed rear leg members 32 may be adjusted. During assembly of the chair 10, a pin, such as at 55, which may also serve as a pivot pin, is directed through front leg assembly 22, through rear leg assembly 32 and through slots 38 on each of the sliding rear legs 34, 36. Thus as the sliding rear legs 34, 36 are moved in and out of the fixed rear leg members 32, the extent of their travel is limited by the extents of the slots 38. Referring additionally to FIG. 3, cross sections of the relevant leg members 32, 34, 36 of the rear leg assembly 30 are therein depicted. Biasing means 60, shown as a compressible spring, is contained within each of the sliding rear legs 34 and 36, by a pivot pin 55 on one end and by a stop pin 58 proximal the other end. Rear leg assembly 32A shows biasing spring 60 in its relaxed, fully extended condition wherein the pivot pin 55 occupies the upper extent of milled slot 38 (not visible in this figure) of sliding rear leg 34 and provides an upper bearing surface for the spring. Rear leg assembly 32B shows biasing spring 60 in its compressed state compressed between pivot pin 55 and stop pin 58. In this condition, locking means 52 may be engaged to retain the sliding rear leg 36 in its shortened position. In operation, the spaced relationship depicted by rear leg assembly 32B would be typical of a maximum leg adjustment accommodating the steepest slope, about 20°, for which the chair 10 is capable. Similarly, the spaced relationship represented by rear leg assembly 32A would be typical for accommodating a surface with about a zero degree slope. With the potential energy stored in the spring 60 while compressed within each of the respective sliding rear legs 34, 36, it can be appreciated that the chair 10 may be easily adjusted with a single hand, even by a seated individual, by releasing each locking means 52, sitting on the seat 50 of the chair 10, achieving the desired seating inclination, and then engaging locking means 52 to maintain the desire inclination. In addition to a spring providing the biasing means for the sliding rear legs 34, 36, hydraulic or pneumatic cylinders may be adapted in lieu of a spring to provide an equivalent bias energy to mechanically assist in the extension of the leg members.

Referring again to FIGS. 1 and 2, seat 50 is formed by suspending a flexible material between the upper horizontal members 23, 35 of both the front and rear leg assemblies 20, 30. The flexible material preferably consists of a rugged natural fabric, such as canvas, a man-made fabric, such as E.I. du Pont de Nemours and Company NYLON® or other suitable material which is long wearing and geared for outdoor use. When chair 10 is unfolded, the material forming seat 50 provides a sturdy, yet flexible and comfortable seat. The seat 50 material may be secured to the upper horizontal members 23, 35 of assemblies 20 and 30 with fasteners, such as nails, screws, staples or the like. However, it is preferable to provide loops on the front and rear portions of the flexible material, either by sewing, zippers, snaps or other captive means to accommodate the horizontal members 23, 35 passing through the loops without being rigidly fastened. The added advantage of providing for a removable seat 50 is that it can be easily removed for cleaning or replacement by the user without the use of tools.

The configuration of back support assembly 40 may be clearly seen in FIGS. 1 and 2. Of similar construction to the front and rear leg assemblies 20 and 30, the back support assembly 40 is preferably constructed of a tubular material such as aluminum, steel, plastic or other composite material. The back support assembly 40 is comprised of two vertical parallel back support members 42 spaced apart by a horizontal back support member 43, constructed as a unitary frame or fabricated from component parts and joined with elbows, as at 28. At the uppermost extent of vertical back support members 42 is located a back support brace 44 over which a back cushion 45 may be applied. Back support brace 44 provides both comfort for the user of the chair 10, as well as additional overall structural support. Back support brace 44 may be constructed of wood, plastic or metal and may be configured to display printed information or advertising. In this embodiment, the ends of each of the back support members are preferably closed off with suitable plugs, as at 49. In alternate embodiments back support brace 44 may be augmented or replaced by a horizontal tubular member 46, or a chair back 48. Horizontal tubular member 46 and chair back 48 are shaped to fit into the ends of the back support members 42. The chair back 48 is preferably constructed from tubular extensions 51 and a material similar to seat 50, and may be overprinted to display information or advertising. Near its lower extent, back support assembly 40 is pivotally attached to the front leg assembly 20, near its upper extent, as at pivot points 54B. The back support assembly 40 is preferably located on the outside of front leg assembly which, in turn, is located on the outside of rear leg assembly 30. In this arrangement, chair 10 will collapse into a flattened configuration for transport and storage when it is picked up by horizontal back support member 43. To assist in this takedown procedure and to provide a means of manually transporting chair 10, a carrying strap 56 is provided, attached to horizontal back support member 43.

Slidable sleeves, as at 62, may be provided on both front leg members 20 between pivot points 54A and 54B. The sleeves 62 are made of a resilient material, such as rubber or soft plastic, and provide for adjustment of the inclination of back support assembly 40 by sliding them up or down the front leg members 22. When in position, such as shown in FIG. 2, the sleeves 62 are confronted by a portion of lower horizontal back support member 43, thus determining how far back the back support assembly 40 may be rotated during deployment. The sleeves 62 also provide for some cushioning effect for the seated user as well as for sound deadening between confronting metal components. A drink holder 64 may be provided as an accessory to chair 10. The drink holder 64 is preferably pivotally attached to a sleeve 66 which may be slid up and down the rear leg member 32, as well as around it, to the underside of seat 50 for storage.

While the present invention has been described in accordance with preferred compositions and embodiments, it is to be understood that certain substitutions and alterations may be made thereto without departing from the spirit and scope of the following claims.

What is claimed is:

1. A portable folding chair for use on varying sloped surfaces ranging from about zero degrees to about twenty degrees comprising:

a front leg assembly constructed of tubular material, said assembly having first and second parallel forward leg members and a horizontal member located at upper extents of said forward leg members, in spaced relationship therewith and providing a rear seat support;

a rear leg assembly constructed of tubular material of a first diameter and being pivotally attached to said front leg assembly, said rear leg assembly having first and second parallel fixed rear leg members and a horizontal member located at upper extents of said rear leg members, in spaced relationship therewith and providing a front seat support;

first and second sliding rear legs constructed of a tubular material of a second diameter telescopically engaged with said first and second rear leg members;

first and second locking means located near lower extents of said first and second rear leg members for retaining said first and second sliding rear legs in a select position within a range of continuously variable positions until unlocked;

a seat comprised of flexible seating material suspended between said front and rear seat supports; and a seat back assembly constructed of tubular material and being pivotally attached to said front leg assembly, said seat back assembly having first and second vertical parallel seat back members, a first horizontal member located at lower extents of said seat back members, in spaced relationship therewith, and a second horizontal member located at an upper extent of said seat back.

2. The portable folding chair of claim 1 wherein said rear leg assembly further comprises a first and second biasing means acting against said first and second fixed rear leg members and said first and second sliding rear legs for mechanically assisted extension of said sliding leg members from said fixed leg members when said locking means are selectively disengaged.

3. The portable folding chair of claim 2 wherein said biasing means are compressible springs.

4. The portable folding chair of claim 1 wherein said first and second sliding rear legs are slotted for limiting engagement by guiding pins extending through each of first and second fixed rear leg members.

5. The portable folding chair of claim 4 wherein said guiding pins also provide pivoting points between said front and rear leg assemblies.

6. The portable folding chair of claim 1 wherein said second horizontal member located at the upper extent of said seat back assembly is of tubular construction and matingly engages upper extents of said first and second vertical parallel seat back members.

7. The portable folding chair of claim 6 wherein said seat back assembly additionally comprises a flexible seat back cover slidably engaged over the upper extent of said assembly.

8. The portable folding chair of claim 1 wherein said front leg assembly additionally comprises at least one external sleeve mounted near an upper extent of said assembly in confronting relationship with a lower portion of said seat back assembly effective for adjusting inclination of said seat back.

9. The portable folding chair of claim 1 wherein said rear leg assembly additionally comprises a pivotable and storable receptacle operatively configured to hold beverage containers when said receptacle is pivoted from said stored condition.

10. A portable folding stool for use on varying sloped surfaces ranging from zero degrees to about twenty degrees comprising:

a front leg assembly constructed of tubular material, said assembly having first and second parallel forward leg members and a horizontal member located at upper extents of said forward leg members, in spaced relationship therewith and providing a rear seat support;

a rear leg assembly constructed of tubular material of a first diameter and being pivotally attached to said front leg assembly, said rear leg assembly having first and second parallel fixed rear leg members and a horizontal member located at upper extents of said rear leg members, in spaced relationship therewith and providing a front seat support;

first and second sliding rear legs constructed of a tubular material of a second diameter telescopically engaged with said first and second rear leg members;

first and second locking means located near lower extents of said first and second rear leg members for retaining said first and second sliding rear legs in a select position within a range of continuously variable positions until unlocked; and a seat comprised of flexible seating material suspended between said front and rear seat supports.

11. The portable folding stool of claim 10 wherein said rear leg assembly further comprises a first and second biasing means acting against said first and second fixed rear leg members and said first and second sliding rear legs for mechanically assisted extension of said sliding legs from said fixed leg members when said locking means are selectively disengaged.

12. The portable folding stool of claim 11 wherein said biasing means are compressible springs.

13. The portable folding stool of claim 12 wherein said first and second sliding rear legs are slotted for limiting engagement by guiding pins extending through each of first and second fixed rear leg members.

14. The portable folding stool of claim 13 wherein said guiding pins also provide pivoting points between said front and rear leg assemblies.

15. The portable folding stool of claim 10 wherein said rear leg assembly additionally comprises a pivotable and storable receptacle operatively configured to hold beverage containers when said receptacle is pivoted from said stored condition.

* * * * *